United States Patent [19]

Fiedler et al.

[11] 4,420,697

[45] Dec. 13, 1983

[54] PROCESS AND APPARATUS FOR MONITORING THREAD BREAKAGE BY THE USE OF A THRESHOLD DEVICE

[75] Inventors: Gerhard Fiedler, Greiz; Werner Fritzsche, Greiz-Moschwitz; Frank Herold; Uwe Tolkmitt, both of Greiz, all of German Democratic Rep.

[73] Assignee: VEB Kombinat Wolle und Seide, Meerane, German Democratic Rep.

[21] Appl. No.: 251,811

[22] Filed: Apr. 7, 1981

[30] Foreign Application Priority Data

Apr. 29, 1980 [DD] German Democratic Rep. ... 220763
Oct. 9, 1980 [DD] German Democratic Rep. ... 224417
Nov. 21, 1980 [DD] German Democratic Rep. ... 225376

[51] Int. Cl.[3] ..... D01H 13/16; G01R 29/12; D04B 35/14

[52] U.S. Cl. ..... 307/308; 328/5; 57/81; 57/265

[58] Field of Search ..... 307/308, 231; 328/1, 328/5; 57/81, 264, 265

[56] References Cited

U.S. PATENT DOCUMENTS

| | | | |
|---|---|---|---|
| 3,974,665 | 8/1976 | Rencin et al. | 57/81 |
| 4,007,457 | 2/1977 | Aeppli | 57/264 |
| 4,097,769 | 6/1978 | Wilson et al. | 307/308 |
| 4,258,326 | 3/1981 | Johne | 307/308 |
| 4,280,322 | 7/1981 | Inger | 57/81 |

*Primary Examiner*—John S. Heyman
*Attorney, Agent, or Firm*—Jordan and Hamburg

[57] ABSTRACT

In a process and apparatus for monitoring thread breaks without touching the thread, the stochastic electrical charge of the moving thread is detected without contact by means of a metallic plane electrode disposed at the textile machine close to the moving thread. The change of potential upon the occurrence of a thread break is amplified in a high input resistence amplifier. The output of the amplifier is connected to the threshold device directly or by a capacitor. A reference potential is connected to the threshold device input, and the threshold device outputs a binary signal for indicating the condition of the thread.

11 Claims, 3 Drawing Figures

PROCESS AND APPARATUS FOR MONITORING THREAD BREAKAGE BY THE USE OF A THRESHOLD DEVICE

FIELD OF USE OF THE INVENTION

The invention relates to a process and an apparatus for the detection of thread breaks in textile machines, preferably spinning machines, by providing a binary signal, adapted to indicate the condition of the thread.

CHARACTERISTICS OF KNOWN TECHNICAL SOLUTIONS

Heretofore mechanical, inductive, optical and capacitive processes and devices were proposed which provide a signal for consecutive information processing when a moving thread breaks.

Mechanical monitoring processes and devices are based exclusively upon the principle that a movably supported lever scans the moving thread and that—in case of a thread break—the resultant motion of the lever is transformed into releasing an electrical contact. The disadvantage of these solutions is the constant physical contact of the running thread as well as the positioning of the lever upon the thread after repair of the thread break by the service personnel.

Mechanical monitoring devices call for excessively high service expense and are not very reliable.

Inductive processes and devices for the detection of a thread break are based upon the principle of noticing the motion of the ring traveller of a spinning machine, which stops at a thread break or rotates with a noticeable lower speed, respectively. This ring traveller usually crosses a magnetic field at each revolution, produced by an electromagnet. Due to the change of the magnetic flux when the ring traveller enters the magnetic field, an evaluable sequence of pulses results which is proportional to the RPM of the ring runner and which is therefore useful for the detection of a thread break. The disadvantage of such solutions is the high cost the manufacturing of electromagnets needed for such solutions.

Optical monitoring devices and processes consist of an emitter and a receiver. The thread to be monitored runs between emitter and the receiver releases a pulse upon a thread break due to increased light flux between emitter and receiver. This pulse is used for detection of the thread break. The disadvantage of such arrangements is the low reliability of operation due to high amounts of dust and fluff, produced by textile machines, which are capable of covering the beam path between emitter and receiver, thus preventing operation of the device.

Capacitative devices and processes are based upon the principle of variations of capacity, for instance of a plate capacitor, where the thread functions as the dielectric. Thus, upon missing a thread, a change of the constant of capacity occurs, which again results in an evaluable change of capacity.

Large environmental loads, like dust and fluff, are capable of reducing the basically low variations of capacity when the thread breaks so that either reliable evaluation of a signal is no longer possible, is required extremely expensive circuitry is required.

In order to transform an input signal in a binary permanent signal in the presence of stochastic potential pulses of different pulse width, it is known that the pulses are first amplified by an amplifier and that a pulse shaping step follows the amplifier, transforming the pulses into square pulses. After this pulse formation, the rectangular pulses influence an integration step which forms an arithmetical average of the square pulses. A delayed threshold device, coupled thereto, is used for the transformation to a binary permanent signal.

The disadvantage of such processes and arrangements is on the one hand the use of expensive circuits and on the other hand the use of an integrator, which must fulfill high requirements in the event that no pulses arrive at the input end of the integrator and that a no defect-signal appears at the output end of the whole arrangement due to the always present drift of an integrator.

It has been proposed to evaluate the needed threshold devices by current triggers or by the aid of operational amplifiers, operating as Schmitt-Triggers.

Discrete delay threshold devices have the disadvantage that due to positive feedback produced by an emitter resistance or source resistance, the output signal digresses from the reference signal in the two required discrete states. The remaining residual potential must therefore be blocked by additional circuitry. Current triggers are disposed in such a way that they are realized in a bipolar mode and that therefore the input resistance is relatively low and the time constant of a RC-network, connected in series, is very limited or additional circuit means must be provided respectively.

Delayed threshold devices, formed of operational amplifiers have, considering further processing of the input signal, the disadvantage that conversion in a logic element cannot proceed without additional control means.

OBJECT OF THE INVENTION

The object of the invention is the provision of a thread break monitor, using simple means, the monitor being free of disturbance created by environmental loads and also needing no maintenance.

DESCRIPTION OF THE NATURE OF THE INVENTION

The invention provides a process and a device using an electronic delay threshold device with time-delay device, where the thread is not contacted and where a retransmitted binary consecutively determinable permanent signal is produced with the aid of electronic building blocks, by themselves known, said signal being significant for the process stages: or thread break, respectively.

According to the invention, this object is achieved by detecting the electrical potential of the thread arising in the physical motion of the thread without contacting the thread. It is detected in the form of a counter charge, arising from the electrostatic induction of the moving thread by means of a flat or concave plane electrode disposed at the textile machine in the vicinity of the moving thread. A high-resistance amplifier amplifies the potential arising at the electrode so that a change of potential on breaking of a thread increases sufficiently for a useful output signal. The amplifier has an input resistor in the meg.-Ohm range, connected in parallel with an additional resistor and/or a non-linear semiconductor element, preferably a Zener diode.

The thread is disposed at a distance from the electrode and the electrode is connected to a high-resistive amplifier which outputs a determinable potential signal.

The distribution of the charge upon the thread has a stochastic character and therefore the potential arising on the electrode is a small stochastically occurring potential-signal, which is indicative of the manufacturing stage "thread run" and which is applied to the amplifier which acts as an amplifier of potential.

The output of the amplifier is connected to the input of a delayed threshold device either directly or by a capacitor while at the input of the delayed threshold device is connected besides the output of the series connected amplifier a comparative or reference voltage, respectively. The output of the delayed threshold device supplies a subsequently processable binary potential signal.

The stochastical potential signals, to be transformed according to the invention, which occur as a change of potential at the electrode due to the stochastically distributed charges of the thread, are amplified by the amplifier and applied to a delayed threshold device, in which case the threshold device serves simultaneously to form a pulse, to delay a signal and to transform it to a binary permanent signal when pulses are present, said signal being useful for further information processing.

The amplifier accepts the stochastic potential-signal and is connected to the input of a delayed threshold device either directly or by an intermediate capacitor. The delayed threshold device consists of a delay device and a binary component which are connected to each other, or the binary component simultaneously contains the delay device. The input of the delayed threshold device is connected to a source of potential as a reference potential.

According to the invention, a delayed threshold device may be used which has a relatively high input resistance, while additionally level adjustment and potential displacement with independent adjustment of opening and closing values, as well as greater contact time delay are provided.

The output signal of the amplifier acts as an analog voltage signal directly or by way of a capacitor upon a voltage divider whose tap is connected to the gate of a first field effect transistor in a common source circuit, and to the anode of a diode. The drain of the first field effect transistor is connected by a diode in forward direction to the gate of a second field effect transistor also in common source connection. Connected between the gate of the second field effect transistor and reference potential is a parallel connection of a capacitor and a resistor. The drain of the second field effect transistor picks off the discrete signal potential as a binary continuous signal. It is conducted through a resistor or a voltage divider to the cathode of the diode which is connected to the gate of the first field effect transistor. Furthermore, a capacitor may connect the drain of the second field effect transistor to the gate of the first field effect transistor. It is also possible to form resistors and capacitors as integrated circuits. The process and arrangement of the invention makes it possible, by using an electronic delayed threshold device with a time delay when turning-on to detect threads breaks on textile machines without touching the thread and free of maintenance, and to produce a binary, subsequently processable permanent signal that is indicative of the manufacturing stages "thread run or thread break", respectively by using known electronic building blocks.

Disturbances, caused by environmental causes like dust and fluff occurring principally in textile machines, are removed.

BRIEF DESCRIPTION OF THE DRAWINGS

The invention will now be explained in greater detail with reference to the drawings, wherein.

DETAILED DISCLOSURE

Figure 1:
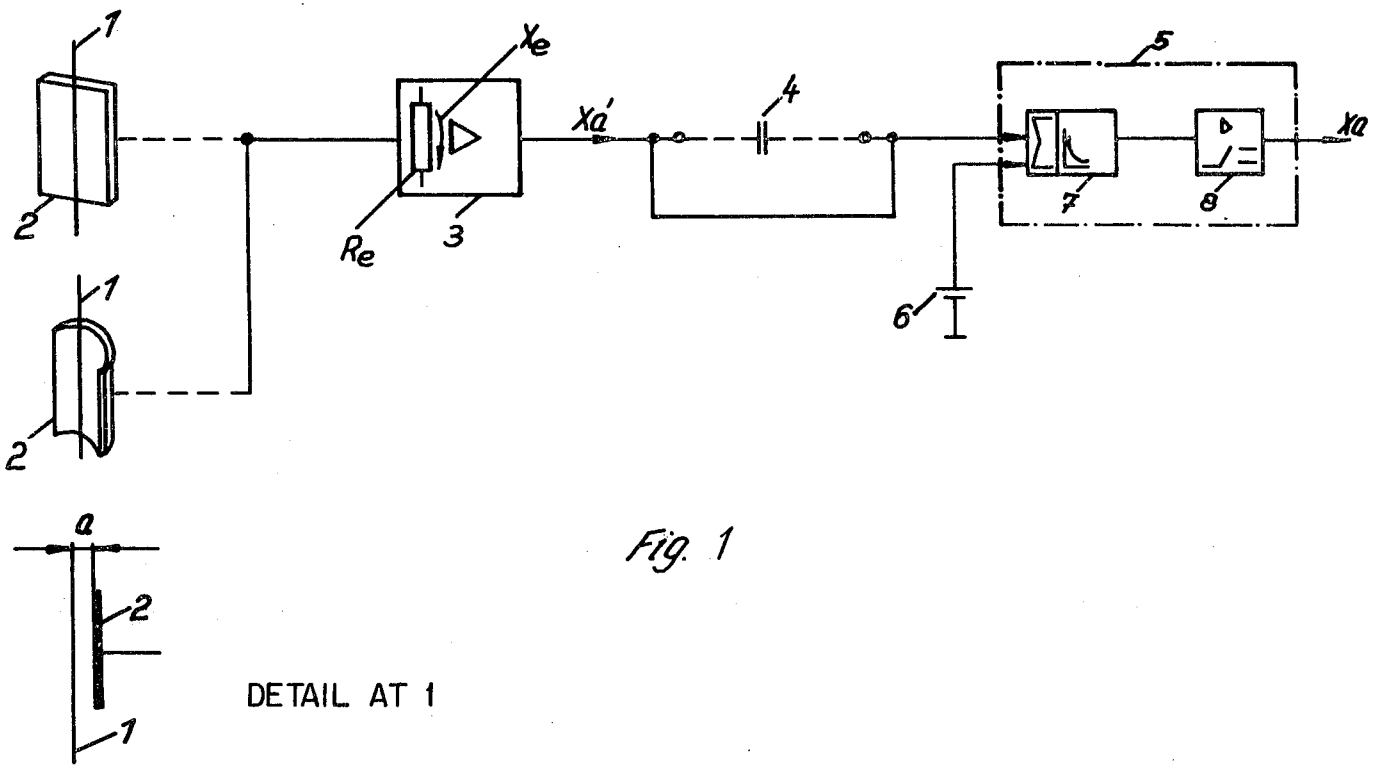
FIG. 1 is a block diagram of the main circuit of the invention.

In FIG. 1 the thread 1 is disposed at distance a from electrode 2. The electrode 2 is connected to a high-resistance amplifier 3 which outputs a determinable potential-signal Xa'. The amplifier 3 has an input resistor Re. Its output is connected directly or by a capacitor 4, respectively to the delayed threshold device 5, in other words to an electronic threshold device with a time delay. The delayed threshold device 5 is furthermore connected to potential source 6 as a voltage reference. The delayed threshold device 5 is comprised of a delay element 7 and a binary element 8 which are connected to each other. Alternatively the binary component 8 may include the delay component 7. The binary continuous signal Xa may be produced at the output of the delayed threshold device.

EXAMPLE 1

Figure 2:
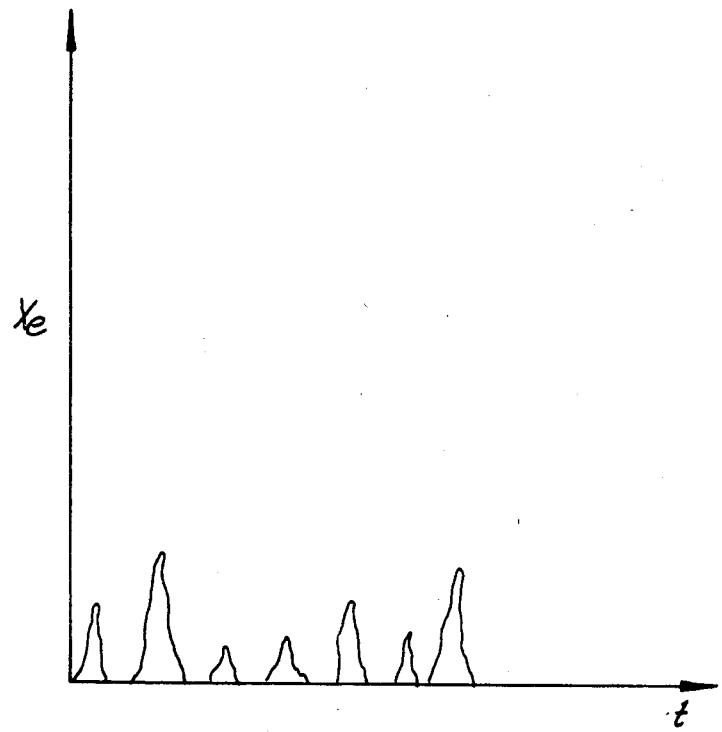
FIG. 2 is a time diagram of the stochastic potential signal at the electrode.

The thread 1 passes electrode 2 at distance a. The electrode 2 may have a flat or a concave metallic surface. The electrical charge, stochastically distributed upon thread 1, produces a countercharge on the electrode 2, by electrostatic induction, equal to the charge upon thread 1. Electrode 2 is also connected to the input of a high-resistance amplifier 3. Due to the fact that electrode 2 presents an equipotential plane, a potential arises from the charge between electrode 2 and input resistor Re or the amplifier 3. This charge is amplified at the output of the amplifier 3, yielding a determinable potential signal Xa'. When thread 1 passes with its stochastically distributed charged electrode 2 at distance a and speed V, small, stochastically distributed potentials Xe arise in the form of potential pulses upon electrode 2 and thereby upon the input resistor Re. The course in time of these potential pulses is shown in FIG. 2. At the output end of amplifier 3 these potential pulses are amplified as a determinable potential signal Xa'. The charge disappears when thread 1 breaks and the potential changes at the input end of amplifier 3 so that no more potential pulses arise.

That change appears also as a change of the determinable potential signal Xa' at the output of the amplifier 3 and thereby signals the presence of the moving thread 1 in front of electrode 2. The input resistor Re of the amplifier 3 may also be connected to a resistor or a non-linear semiconductor element, for instance a Zener diode.

Due to the thread movement, the small stochastically distributed potentials Xe are amplified sufficiently at the input resistor Re of amplifier 3, that the amplitudes of the potential signal Xa' suffice to overcome the switching-hysteresis of the flip-flop 8 so that the flip-flow 8 switches over. In order to prevent the effect of interference potentials, a capacitor 4 may be connected between amplifier 3 and the delayed threshold device 5. A binary constant signal Xa at the logic state 0 appears at the output end of the delayed threshold device 5 when the flip-flop 8 switches to represent the condition that the moving thread is present.

Simultaneously with the switch-over to the "thread present" condition, the delay device 7 in the delayed threshold device charges up to a potential of constant amplitude. When an irregular pause now occurs between the potential signals, the flip-flop device 8 is able to switch back to "logic 1" only when the delayed threshold device 5 has been discharged. When, during the discharge, new potential signals Xa' occur, then renewed rapid recharging of the time-delay device 7 occurs.

The time delay selected of the discharge is a function of the expected pause of the potential signal Xa'. If no further potential signals appear after the determined time, the output of the flip-flop 8 switches to the state "logic 1". The reference potential of the potential source 6 at the input of the delayed threshold device 5 causes the secure position "logic 1" of the delayed threshold device 5 when the potential signals Xa' are missing.

The device may alternatively be connected in such a way that the binary permanent signal Xa has the opposite level.

Figure 3:
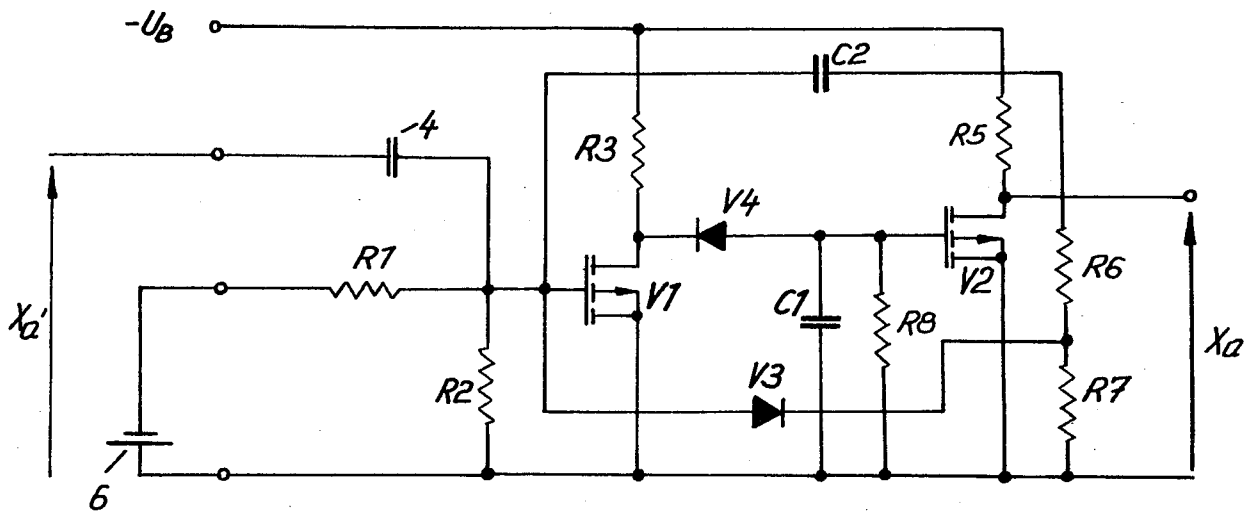
FIG. 3 is a circuit diagram of a delayed threshold device.

In order to explain the arrangement in its circuitry of the delayed threshold device 5, see FIG. 3. This arrangement requires the delayed threshold device 5 to be switched on when the field effect transistor $V^2$ is blocked.

The threshold device 5 is switched off when the field effect transistor $V^2$ is in its conducting mode. Thus two discrete states are valid for the output signal.

$Xa \approx -U_8$ for "in" $\hat{=}$ "logic 1"

$Xa \approx 0$ for "out" $\hat{=}$ "logic 0"

The operation will be explained starting at the "thread present" state. In order to obtain the desired delay, a circuit consisting of diode $V^4$, capacitor $C^1$ and resistor $R^8$ is connected between the field effect transistors $V^1$ and $V^2$. In the thread present state the field effect transistor $V^1$ is blocked and the field effect transistor $V^2$ is conductive. The permanent binarysignal $Xa=0$. This state corresponds in the arrangement of FIG. 1 to the acting potential signals Xa'. The capacitor $C^1$ is almost charged to the potential of the operating potential $-U_B$ as long as the condition $R^3 << R^8$ is satisfied (charge with constant amplitude, formation of pulse). The charge on condenser $C^1$ acts simultaneously on the high resistance gate of field effect transistor $V^2$ which is conductive. If now the potential signals Xa' are missing at the input of the delayed threshold actuator 5, then the potential source 6 forces the field effect transistor $V^1$ into the conductive mode. Here the point of reversal is determined by the resistors $R^1$, $R^2$ which serve as potential dividers. The potential at the cathode of diode $V^4$ drops by an analogous amount so that the capacitor $C^1$ does not receive any charge because the field effect transistor $V^1$ becomes conductive. Capacitor $C^1$ discharges through resistor $R^8$. Fast discharge of capacitor $C^1$ through the low-resistance drain-source-line of field effect transistor $V^1$ is prevented by diode $D^4$. That means that the time constant of the discharge of capacitor $C^1$ follows the equation $T=R^8 \cdot C^1$. If during the discharge, new potential signals Xa' appear at the input of the delayed threshold device 5 before the threshold potential of the field effect transistor $V^2$ is reached, then the capacitor $C^1$ receives a new charge because the field effect transistor $V^1$ blocks for the duration of the potential signals Xa'. The capacitor $C^1$ discharges completely only when potential signals no longer arrive. When the potential at capacitor $C^1$ reaches the threshold potential of the field effect transistor $V^2$, the field effect transistor 2 begins to block and flips, aided by the feedback of resisters $R^6$, $R^7$ and the diode $V^3$, into the state "logic 1" $= -U_8$.

This arrangement results in a time delay defined by:

$$t_v = -T.1_n \frac{U_T}{U_8}.$$

The stochastic potential signal may be transformed by this into the binary continuous signals $Xa=\log.1$ or $Xa=\log.0$ and be used for further information processing.

We claim:

1. An apparatus for monitoring breakage of a moving thread, comprising a flat or concave plane electrode positioned in the proximity of but not touching the thread so that an electrical charge corresponding to the stochastic charge on the thread is electrostatically induced on said electrode, and an amplifier having a high input impedance connected to said electrode so that a potential signal corresponding to the stochastic charge is provided at the output of said amplifier, so long as the thread has not broken.

2. An apparatus according to claim 1, characterized in that the amplifier has an input resistor in the megohm range, connected in parallel with an additional resistor.

3. The apparatus of claim 8 further comprising a delayed threshold device coupled to receive said potential signal, said delayed threshold device being coupled to a source of reference potential, whereby the output of said delayed threshold device produces a binary output signal.

4. An apparatus according to claim 3, characterized in that the delayed threshold device performs simultaneously a pulse formation, signal delay and transformation in a binary permanent signal when potential signals are present, said permanent signals being useful for subsequent information processing.

5. An apparatus according to claim 4, characterized in that the potential signal is appled to resistors connected as a potential dividers, wherein the divider tap is connected to the gate of a first field effect transistor in common source connection and the anode of a first diode wherein the drain of the first field effect transistor is connected through a second diode in forward mode with the gate connection of the second field effect transistor in common source connection and via a parallel connected condenser and resistor to the reference potential of the circuit, and wherein at the drain of the second field effect transistor the discrete potential signal to be formed is tapped as a binary signal, and wherein the potential signal is simultaneously connected by resistor means to the cathode of the first diode connected to the gate of the first field effect transistor and wherein a capacitor is also connected between the drain of the second field effect transistor and the gate of the first field effect transistor.

6. A delayed threshold actuator according to claim 5, characterized in that resistors and capacitors are formed as integrated circuits.

7. The apparatus of claim 1 wherein the amplifier has an input resistor in the meghom range connected in parallel with an additional non-linear semiconductor element.

8. The apparatus of claim 7 wherein the non-linear semiconductor element is a Zener diode.

9. The apparatus of claim 3 wherein the amplifier is connected directly to said delayed threshold device.

10. The apparatus of claim 3 wherein said amplifier is connected by way of a capacitor to said delay threshold device.

11. Process for monitoring thread breaks without touching the thread, comprising detecting the electrical charge of the thread, arising by its physical movement, without contact, by a countercharge arising from electrostatic induction by the moving thread by means of a flat or concave plane electrode fastened to the textile machine in proximity of the moving thread, and amplifying the potential at the electrode by a high-resistance amplifier so that the change of potential at the occurrence of a thread break is amplified to produce a usable output signal.

* * * * *